US006073798A

United States Patent [19]

Rosenhain

[11] Patent Number: 6,073,798

[45] Date of Patent: Jun. 13, 2000

[54] UTENSIL HOLDING CONTAINER

[75] Inventor: Norma Fay Rosenhain, Castle Hills, Australia

[73] Assignee: Creata Inc., Wilmette, Ill.

[21] Appl. No.: 08/329,086

[22] Filed: Oct. 25, 1994

Related U.S. Application Data

[63] Continuation-in-part of application No. 08/160,613, Dec. 1, 1993, abandoned.

[30] Foreign Application Priority Data

Nov. 18, 1993 [AU] Australia ..... PM2475

[51] Int. Cl.[7] ..... B65D 25/20

[52] U.S. Cl. ..... 220/736; 220/735; 220/592.14; 220/62.12; 206/457

[58] Field of Search ..... 220/735, 736; 206/457

[56] References Cited

U.S. PATENT DOCUMENTS

| | | | |
|---|---|---|---|
| 2,484,776 | 10/1949 | Zent et al. | 206/457 |
| 4,353,476 | 10/1982 | Cowgill | 220/736 |
| 5,178,354 | 1/1993 | Engvall | 220/735 |
| 5,386,909 | 2/1995 | Spector | 206/457 |

FOREIGN PATENT DOCUMENTS

| | | | |
|---|---|---|---|
| 92302010 | 2/1993 | China . | |
| 402674 | 10/1909 | France . | |
| 115303 | 11/1945 | Sweden | 220/735 |
| 2023013 | 5/1992 | United Kingdom . | |

*Primary Examiner*—Joseph M. Moy
*Attorney, Agent, or Firm*—Gifford, Krass, Groh, Sprinkle, Anderson & Citkowski, P.C.

[57] ABSTRACT

A decorative container that has a rigid inner body and a supple outer surface. The container is made of a rigid plastic material and is preferably injection molded. The supple decorative outer member is made of a relatively pliable plastic or rubber and is preferably rotation molded. The outer member has the general shape of a sleeve and is adapted to be slipped over the outer surface of the container so that a unitary appearing container is formed which is sturdy, but which is very supple, with a three-dimensional outer surface. The outer member may be configured to releasably retain a utensil on the exterior surface of the container.

11 Claims, 3 Drawing Sheets

UTENSIL HOLDING CONTAINER

RELATED APPLICATION

This is a continuation-in-part of U.S. patent application Ser. No. 08/160,613 filed Dec. 1, 1993 now abandoned and entitled "Three-Dimensional Container." Priority of Australian Application PM2475 filed Nov. 18, 1993 is claimed and the disclosure thereof is incorporated herein by reference.

FIELD OF THE INVENTION

The present invention relates generally to a decorative container and more particularly to a decorative cup that has the advantages of a rigid cup, but has a supple decorative three-dimensional surface. Most specifically, the present invention relates to a cup which is configured to releasably retain a utensil upon in exterior surface the thereof.

BACKGROUND OF THE INVENTION

There are numerous decorative containers including decorative cups. Most of these have a two dimensional design on their outer surface. Typically, these containers are manufactured from a rigid plastic of some type and the design is put on by painting, silk screening, decaling etc. One problem with this type of cup is that the design has a tendency to fade, peel, etc. Another problem is that the container does not have a pleasant feel because of the rigidity of the container. Still further, these containers have two dimensional designs with three-dimensional designs being more desirable especially in the novelty item market.

There are containers with three-dimensional designs, but the design is typically made of the same material as the container and the container is rather expensive to manufacture. Ceramic material is commonly used to make these containers. One major problem with ceramic containers, particularly in the novelty market is that they are fragile. This is a particular problem if the item is intended for use by children.

Frequently containers such as cups, mugs, bowls and the like are used in conjunction with other utensils such as eating implements, writing implements or toothbrushes. Oftentimes, such utensils are stored within the container; however, it has been found that from a utilitarian aspect as well as an aesthetic and novelty aspect it is desirable to store such utensils by affixing them to an exterior surface of the container.

The present invention provides a durable, easy to manufacture mug or other such container which has a resilient outer surface which bears a three-dimensional raised-relief image. In a further embodiment, the outer surface of the container is adapted to releasably retain a utensil.

SUMMARY OF THE INVENTION

Disclosed herein is a utensil holding container having a body portion with an interior and exterior surface, an open top and a closed bottom. A relatively supple sleeve is mounted about the exterior surface of the body portion of the container. The sleeve has an inner and outer surface with the outer surface of the sleeve having a three-dimensional decorative image on it. The sleeve further includes a gripping portion defined on the outer surface of the sleeve for engaging and holding a utensil. In one embodiment, the decorative image is a representation of a face and the gripping portion is defined by the face's mouth. In some instances, the inner surface has the same contour as the exterior surface of the body portion of the container so that it frictionally engages the exterior surface of the body portion. Preferably, the sleeve is fixed to the rigid body portion by an adhesive applied between the exterior surface of the body portion and the inner surface of the sleeve.

As disclosed, the container may be a cup which has a handle with a first end that is fixed to the body portion and a second end that is releasably connected to the body portion. The handle can be released to allow the sleeve to be slid over the body when the cup is assembled. The handle includes a first locking portion which mates with a second locking portion on the cup. In the preferred embodiment, the handle and the cup have notches and tabs, with each tab mating in the notch of the other member.

Preferably, the bottom and top of the rigid cup are defined by a flange that extends radially outwardly from the body portion. The sleeve is mounted between these flanges. The flanges include generally planar surfaces that are adjacent to the sleeve so that the sleeve appears to be integral with the rigid cup member.

Because of the two-piece construction, the container is preferably made by injection molding the inner member and forming the outer sleeve by rotation molding, injection molding or casting. After molding the components, the container is assembled by sliding the sleeve over the outer surface of the inner member. In order to slide the sleeve over the inner member, the handle is released from the cup. The sleeve is pliable and can be sufficiently stretched to slide over the bottom flange. Further, if assembled immediately after the outer sleeve is molded, the sleeve is warm and can be more easily stretched over the inner member and has a tendency to then contract around the inner member as it cools. Once the sleeve is in place, the handle is reconnected.

DETAILED DESCRIPTION OF THE INVENTION

Figure 1:
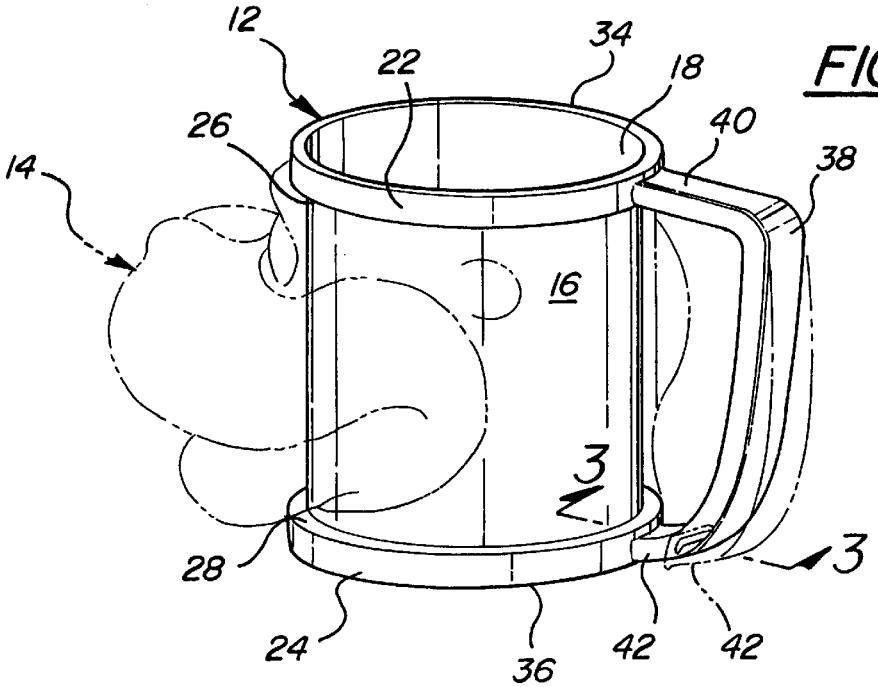
FIG. 1 is a perspective view of a first embodiment of a container of the present invention with the outer sleeve shown in phantom.

With reference to FIG. 1, the one embodiment of container of the present invention is shown generally at 10. Container 10 is illustrated as a cup, but it should be appreciated by those of ordinary skill in the art that the present invention would be applicable to any type of container and the invention should not be limited to a cup.

The container 10 has a generally rigid inner portion 12 and a supple outer portion 14, which will also be referred to as a sleeve. In the preferred embodiment, the inner portion 12 is made of polyethylene and the outer portion 14 is made of a plasticized polyvinyl chloride although it is to be understood that other plastic material may be employed. For example, the inner portion may be made of polystyrene, polycarbonate and the like; and the sleeve may be made of urethane, other vinyls and the like. The outer portion 14 is shown in phantom in FIG. 1 and illustrated in FIG. 2. Preferably, the supple outer portion 14 is adapted to be slid onto the body 16 of rigid inner portion 12 of cup 10. In this way, the cup 10 is provided with a rigid inner portion 12 for containing a substance, such as, for example, food, liquids, etc., and a decorative three-dimensional outer surface which adds aesthetic appeal, and a soft, pliable outer surface that is better to hold.

Figure 4:
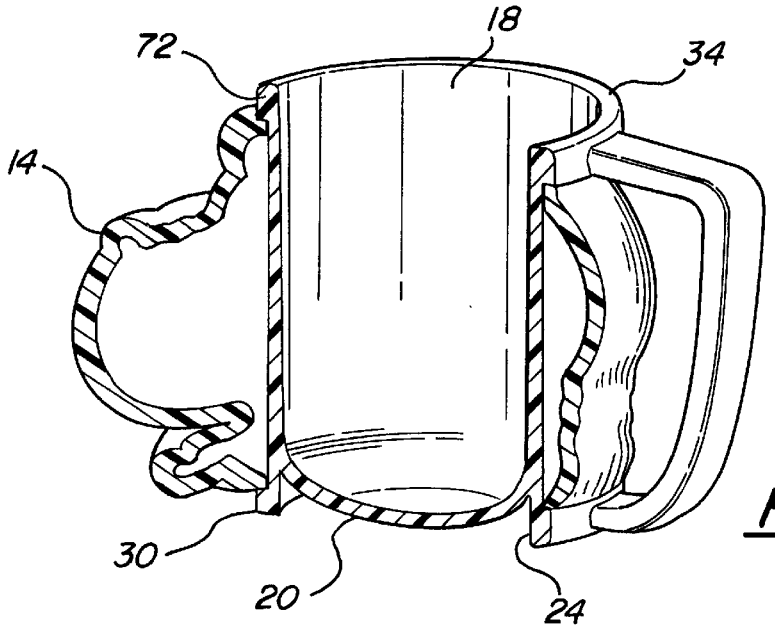
FIG. 4 is a cutaway view of the container of FIG. 1.
Figure 5:
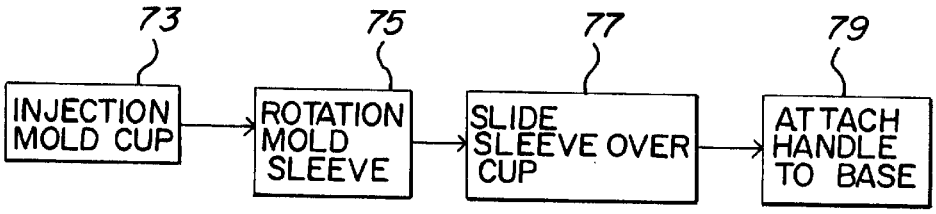
FIG. 5 is a flow chart of the method of making the container of the present invention.

Rigid portion 12 is preferably formed by injection molding with such term defined to include blow molding and other gas assisted processes. With reference to FIG. 5, a schematic of this step is illustrated at 73. Body 16 of inner portion 12 is open at 18 for receipt of the contents to be contained and is closed at its bottom 20. See FIG. 4. In the preferred embodiment, the top and bottom of inner portion 12 include flanges 22 and 24, respectively. Flanges 22 and 24 extend radially outwardly from body portion 16 and have generally planar surfaces 26 and 28 that are opposed to one another. These planar surfaces 26 and 28 have a width, which is approximately equal to the width of top edge 30 and bottom edge 32 of outer portion 14. In this way, when outer portion 14 is properly positioned on body 16, outer portion 14 appears to be an integral part of body 16 and the container 10 appears to be a single piece construction. In the preferred embodiment, the top edge 34 and bottom 36 of cup 12 are rounded to give the container a softer appearance.

Figure 3:
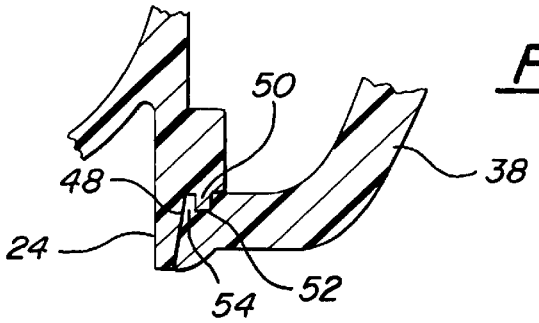
FIG. 3 is a cutaway view taken along line 3—3 of FIG. 1 of the FIG. 1 embodiment.

A handle 38 is provided on cup 12. Handle 38 has a first-end 40, which is integral with cup 12 and a second-end 42, which is removably coupled to the bottom flange 24. With reference to FIG. 3, the configuration of the handle which allows handle 38 to be releasably connected to the bottom flange 24 of cup 12 is illustrated. The bottom flange 24 includes a recess 48 and a tongue 50, which are adapted to mate with a recess 52 and tongue 54 formed in handle 38. As can be seen in FIG. 3, the tongue 54 mates with recess 48, and tongue 50 mates with recess 52 so that handle 38 is locked in position.

Figure 2:
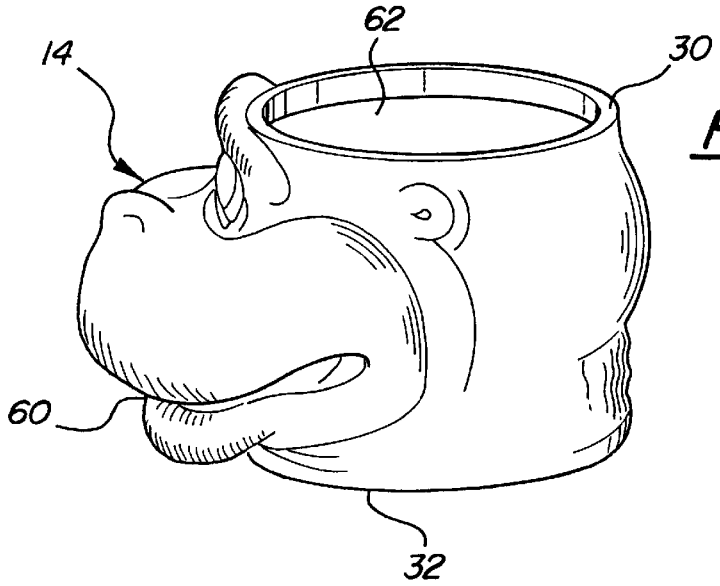
FIG. 2 is a perspective view of the outer sleeve of the FIG. 1 embodiment.

With reference to FIG. 2, the decorative outer sleeve 14 is illustrated with a three-dimensional FIG. 60. In one preferred embodiment, sleeve 14 is formed by rotation molding; although it is to be understood that other processes such as injection molding or casting could he similarly employed. A schematic representation of a process in accord with the present invention is shown in FIG. 5. Depicted is a combination injection-rotation molding process. The rotation molding step uses a mold shown at 75 in FIG. 5. Mold 75 has a cavity with the inverse of the three-dimensional FIG. 60 formed in it. A suitable plastic, such as for example, polyvinyl chloride based material, is introduced into the mold, and the mold is rotated to centrifugally force the plastic material into the inverse cavity to form the three-dimensional FIG. 60. Immediately after the three-dimensional figure is formed, a slight amount of curing is permitted and then, while the plastic material is still setting, it is slipped over the bottom flange 24 and into position about body 16, between flanges 24 and 22. This step is shown at 77 in FIG. 5. In the preferred embodiment, an adhesive is applied between the inner wall 62 of sleeve 14 and body 16 to ensure proper mounting. Once sleeve 14 is positioned between flanges 22 and 24, handle 38 is reattached to flange 24, as shown in FIG. 1 and at 79 in FIG. 5. In FIG. 1, handle 38 is shown moved away from container 12, permitting sleeve 14 to be slid onto container 12 and then shown connected to container 12 once sleeve 14 has been properly positioned on container 12.

Other molding processes and materials may be employed to manufacture the sleeve. For example, the sleeve may be injection molded from a variety of elastomers such as Kraton brand styrene-isobutylene copolymer sold by the Shell Oil Co., or it may be cast from urethane.

Figure 6:
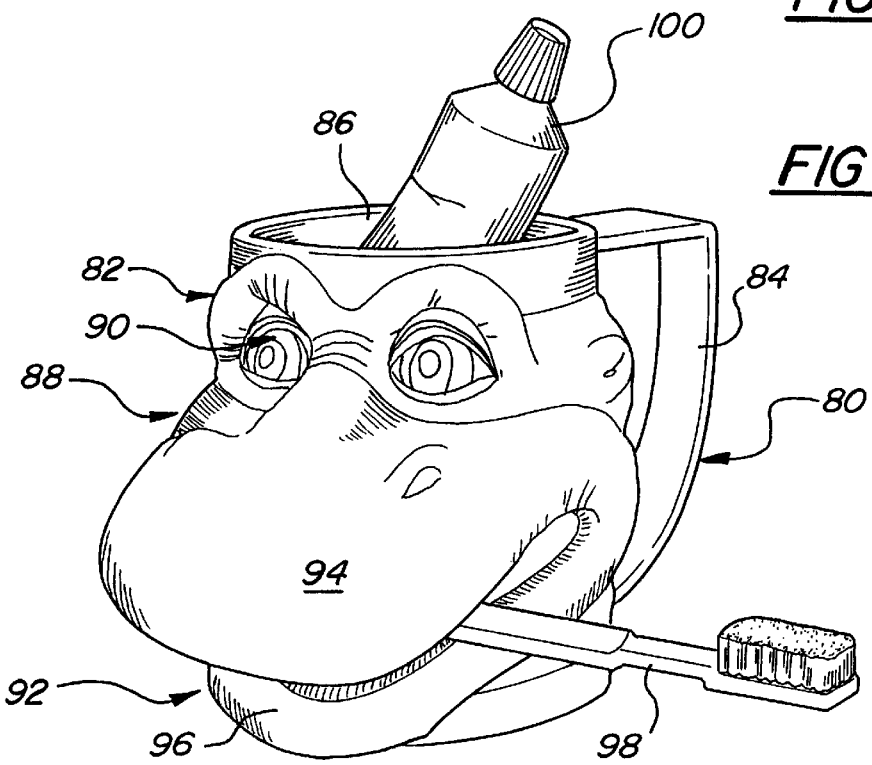
FIG. 6 is a perspective view of another embodiment of a container as particularly configured to releasably retain a utensil.

In accord with the present invention there is also provided a container, which is further adapted to releasably retain a utensil upon an outer surface thereof. One embodiment of the invention so configured will now be described with reference to FIG. 6. Illustrated therein is a mug 80, generally similar to that described hereinabove. The mug 80 includes a body part 82 having a handle 84 and a hollow interior 86. In the illustrated embodiment, the mug 80 includes surface decoration in the form of a cartoon-type face indicated generally at 88, including such features as eyes 90 and a mouth 92.

It is to be noted that in this embodiment of the invention, the mouth 92 includes lips 94 and 96 which are separated so as to define a slot therebetween. In this manner, the lips 94, 96 constitute gripping members which cooperate to define a gripping portion of the mug which releasably retains a utensil, such as the toothbrush 98. The slot defined by the lips 94, 96 can be such as to allow the handle of the toothbrush 98 to slide easily thereinto. Alternatively, the outer sleeve member of the mug 80 may be fabricated from a resilient material, and the lips configured so that there is some deflection of the lips required in order to mount the toothbrush in the slot. In any instance, the gripping member of the present invention is unitary with the sleeve, insofar as it is integral with, and formed from a portion of the material of the sleeve.

In the example illustrated, the mug is such as would be used by a child when cleaning teeth, either as a holder for toothpaste 100, or more likely to hold water in which the user would wet the toothbrush during the tooth cleaning operation. The example of the toothpaste and toothbrush herein given is not to be considered as limiting. Other possible uses could be for eating utensils, as for example with a spoon between the cartoon character's lips and a knife and fork housed in the mug. The container could also be configured as a napkin holder with a knife, fork and spoon in the mug. The container could also be used to hold writing implements such as pens and pencils in the mug, with one mounted between the lips of the cartoon character.

The container of the present invention may be still otherwise configured. For example, it may be adapted for the mounting of alternate cartoon faces, and in fact, other representations could be used in place of faces. For example, the container may be configured to resemble the toe end of a shoe where the lips of the cartoon character are replaced by portions representing a shoe sole and a shoe upper separated (as in a damaged shoe) with a slot therebetween to support the desired article.

Figure 7:
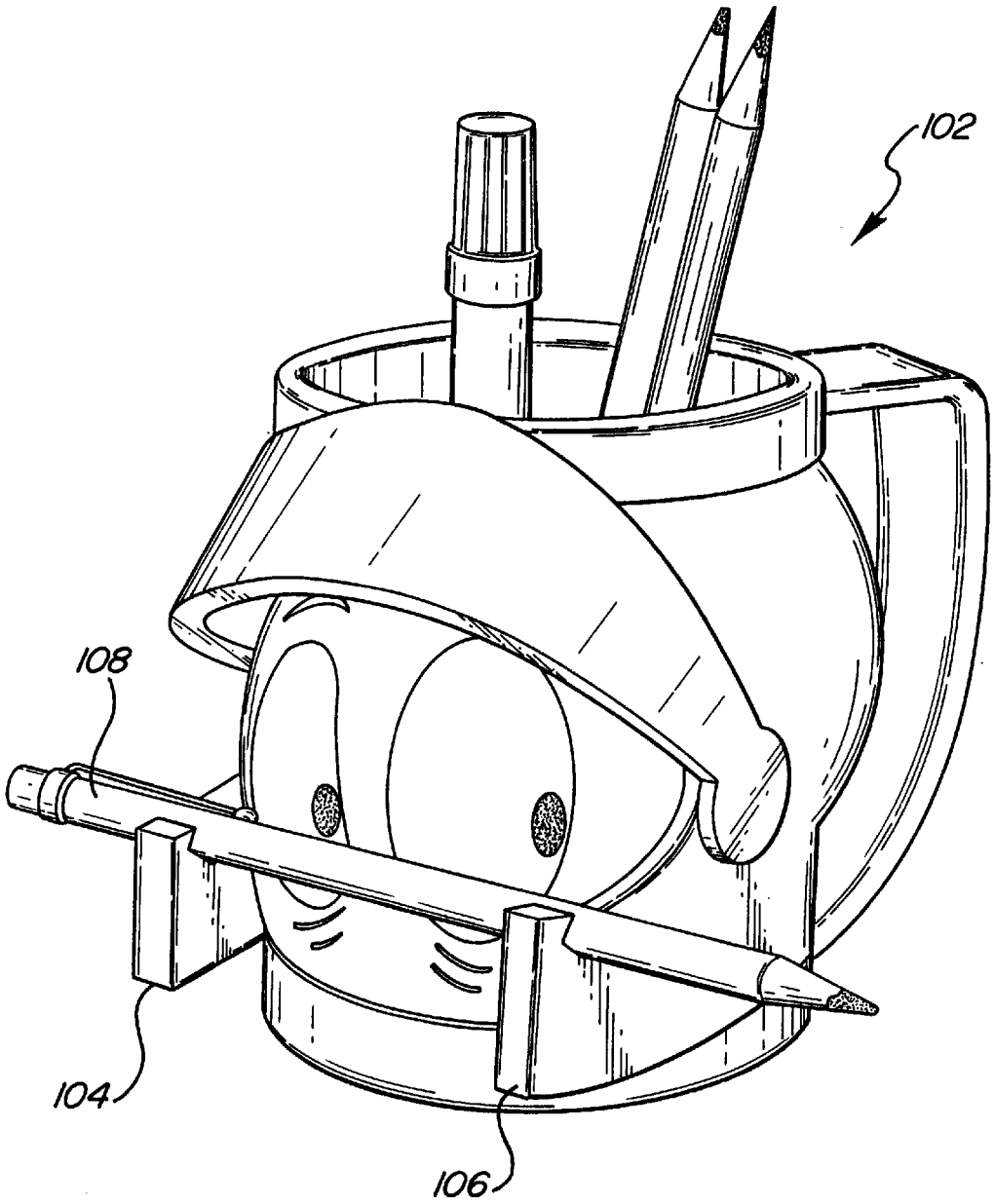
FIG. 7 is a perspective view of yet another embodiment of utensil retaining container, structured in accord with the present invention.

In another embodiment, for example, as illustrated in FIG. 7, the container is configured as a mug 102 bearing the likeness of a knight in a helmet. In this embodiment, projecting helmet portions 104, 106 support an article, which in this instance is a pen 108.

In accordance with the provisions of the patent statutes, the present invention has been described in what is considered to represent its preferred embodiments. However, it should be noted that the invention can be practiced otherwise and is specifically illustrated and described without departing from its spirit and scope.

What is claimed is:

1. A two-piece utensil holding container comprising:

a rigid inner member having a body portion with an interior and exterior surface, an open top and a closed bottom;

a supple, sleeve member mounted about the exterior surface of the body portion of the inner member, said sleeve member having an inner and outer surface, said outersurface of said sleeve member having a three-dimensional decorative image molded thereon, said decorative image including a portion defining at least one gripping member, which is configured to engage and removably hold a utensil.

2. The utensil holding container of claim 1, wherein said gripping portion includes two resilient gripping members.

3. The utensil holding container of claim 1, wherein said three-dimensional decorative image comprises a representation of a face and said gripping portion is defined by a mouth portion of said face.

4. The utensil holding container of claim 1, wherein said gripping portion is configured to engage and hold a utensil selected from the group consisting of: eating utensils, writing utensils and toothbrushes.

5. The utensil holding container of claim 1, wherein said sleeve member is fixed to said rigid inner member by an adhesive applied between said exterior surface of said rigid inner member and said inner surface of said sleeve member.

6. The utensil holding container of claim 1, wherein said rigid inner member includes a handle having a first end fixed to said rigid inner member and a second end releasably connected to said rigid inner member.

7. The utensil holding container of claim 6, wherein said bottom includes a flange extending radially outwardly from said body portion with a slot formed therein and wherein the second end of said handle is configured to engage said slot.

8. The utensil holding container of claim 1, wherein said bottom and said top each include a flange extending radially outwardly from said body portion;

said outer member being received about said body portion between said flanges.

9. The utensil holding container of claim 8, wherein said flanges include generally planar surfaces adjacent to said outer member;

whereby said outer member appears to be integral with said rigid inner member.

10. The utensil holding container of claim 1, wherein said rigid inner member is injection molded from polyethylene.

11. The utensil holding container of claim 1, wherein said sleeve member is rotationally molded from polyvinyl chloride.

* * * * *